US007971380B1

(12) United States Patent
Gussalli Beretta

(10) Patent No.: US 7,971,380 B1
(45) Date of Patent: Jul. 5, 2011

(54) BREAK-OPEN OVER-AND-UNDER RIFLE EQUIPPED WITH SELECTIVE CONTROLLED HULL EXTRACTION DEVICE

(75) Inventor: Ugo Gussalli Beretta, Gardone Val Trompia (IT)

(73) Assignee: Fabbrica D'Armi Pietro Beretta S.p.A., Gardone Val Trompia (Brescia) (IT)

( * ) Notice: Subject to any disclaimer, the term of this patent is extended or adjusted under 35 U.S.C. 154(b) by 528 days.

(21) Appl. No.: 11/985,758

(22) Filed: Nov. 16, 2007

(30) Foreign Application Priority Data

Nov. 22, 2006 (IT) ..... MI2006A2231

(51) Int. Cl.
*F41A 15/00* (2006.01)

(52) U.S. Cl. ..... 42/46

(58) Field of Classification Search ..... 42/46, 47
See application file for complete search history.

(56) References Cited

U.S. PATENT DOCUMENTS

| | | | | |
|---|---|---|---|---|
| 114,230 | A * | 4/1871 | Tiesing et al. | 42/40 |
| 803,277 | A | 10/1905 | Ellstrom | |
| 2,952,933 | A * | 9/1960 | Stevens | 42/106 |
| 3,984,933 | A * | 10/1976 | Ruger | 42/47 |
| 4,980,985 | A * | 1/1991 | Dumortier | 42/46 |
| 5,018,293 | A * | 5/1991 | Mainland | 42/77 |
| 2004/0128898 | A1* | 7/2004 | Popikow | 42/47 |

FOREIGN PATENT DOCUMENTS

| | | |
|---|---|---|
| FR | 2 205 903 A | 9/1970 |
| WO | WO02/084198 A | 10/2002 |

OTHER PUBLICATIONS

Extended European Search Report, Dated Feb. 25, 2008.

* cited by examiner

*Primary Examiner* — Bret Hayes
*Assistant Examiner* — Reginald Tillman, Jr.
(74) *Attorney, Agent, or Firm* — Hedman & Costigan, P.C.; James V. Costigan

(57) ABSTRACT

A break-open over-and-under rifle (21) comprising an upper barrel (23*s*) and a lower barrel (23*i*) assembled close to a breech (24) thereof in a sleeve (A) to which an action body (B) is hinged through a hinge pin (P), two symmetrical side seats (30) being made on the sides of the sleeve (A) at the sides of the upper barrel (23*s*) close to the lower barrel (23*i*) and close to the breech (24) of the barrels, each side seat (30) being intended to receive an extractor (60*a*, 60*b*) in sliding engagement actuated by a spring (6), for each of the extractors (60*a*, 60*b*) selector means (70) being foreseen fixedly connected to the sleeve (A) each able to be positioned in an engagement position of the corresponding extractor (60*a*, 60*b*) intended to limit its sliding or in a disengagement position of the corresponding extractor (60*a*, 60*b*) intended to allow it to slide freely.

7 Claims, 7 Drawing Sheets

BREAK-OPEN OVER-AND-UNDER RIFLE EQUIPPED WITH SELECTIVE CONTROLLED HULL EXTRACTION DEVICE

The present invention refers to a break-open over-and-under rifle equipped with selective controlled hull extraction device.

In the field of firearms, extractor devices, intended to eject the spent hull, are known.

The spent hull to be replaced with an active cartridge must be extracted from the chamber where it was positioned and in some way ejected from the case frame and from the firearm itself.

Extraction takes place by fastening a special geometric member—defined as head or nail of the extractor—on the shell rim.

The action of the extractor is thus necessary for spent hulls in the operation of semi-automatic or automatic firearms.

An example of a central part of an over-and-under firearm in a partially sectioned top view, equipped with extractors according to the prior art, closed or open in various positions, is schematically shown in FIGS. 1 to 3; a detail illustrating a pair of extractors according to the prior art, isolated from the rifle, is illustrated in FIG. 4.

In the rifle 1 according to the prior art, the sleeve of the barrels is indicated with A and the action body hinged through a hinge pin P to the sleeve is indicated with B.

A fore-end iron 3 is fixed under the sleeve to control the breaking open of the rifle.

An extractor 2 actuated by a spring 6 equipped with a thrusting capsule 7 is mounted on each side of the sleeve.

Each extractor 5 is guided while the barrels are broken open through a pin 8 projecting centrally and laterally from the extractor itself guided in a seat 9 foreseen in the side of the action body B.

The rifle is also equipped with a system for retaining the extractor performed through a fore-end iron lever 10 that through an edge 10' of an end thereof interferes with a tooth 11 with which the extractor is provided at an end.

The fore-end iron lever 10, through an end 10" thereof opposite the edge 10', is also in contact with a cocking rod 12 foreseen in the lower portion of the action body and fixedly connected to it.

From the locked position after firing illustrated in FIG. 1, the extractor 2 begins the extraction manoeuvre following the suitable seat 9 in the action body B with its own pin 8.

In this first step known as mechanical lifting, the extractor after limited sliding comes out from the sleeve for a predetermined distance equal to about 4 mm (FIG. 3).

Then, proceeding to open the rifle, the extractor interrupts its movement so that the fore-end iron lever 10, meeting the resistance of the cocking rod 12, does not manage to rotate freely and is forced to insert under the tooth 11 of the extractor itself preventing it from moving.

Continuing in the opening movement, the barrels of the rifle, rotating about the hinge pin P, reach an opening angle such that the fore-end iron lever 10, which has slowly continued to rotate about its own hinging point, allows the tooth 11 of the extractor to "escape" the edge 10' of the lever itself, i.e. bypass such a tooth 11 allowing the extractor to make the movement that it had previously been prevented from making.

Once the edge 10' of the lever 10 has escaped the tooth 11, the spring 6 of the extractor, which had stayed compressed since the extractor was held in position, instantly releases all of the elastic energy stored by the mechanism allowing the hull C to be rapidly ejected. In certain cases this impulsive extraction is particularly useful since it allows the shooter to quickly reload, however in this step it is possible for the shooter or anybody near to him to be struck by the hull after firing especially when the rifle is opened very quickly following impulsive gestures.

The ejected hull can also easily be lost, in the case of shooting taking place over rough ground (e.g. when hunting), with clear environmental damage.

The Applicant has therefore realised the need to make a break-open over-and-under rifle equipped with extractor device that allows controlled ejection of the hull or cartridge.

The Applicant has therefore set itself the further technical problem of making an over-and-under rifle equipped with a device intended to select such control of the extraction of the hull from the barrel so as to leave the shooter the freedom to choose whether or not to actuate the selective controlled extraction device according to the use of the rifle.

The Applicant has been able to solve the aforementioned technical problems by providing a rifle equipped with a selective extraction device that allows controlled extraction that pulls the case-head out for a few millimeters so as to allow it to be gripped manually for complete extraction so as to avoid a violent expulsion being able to cause the hull to be lost or cause damage to the shooter by striking him.

According to a first aspect of the present invention a break-open over-and-under rifle equipped with selective extraction device for each barrel is therefore provided that is intended to be positioned in a position for engagement of the extractor to limit its sliding to a predetermined value that is sufficient to extract the hull from the barrel allowing it to be gripped.

According to another aspect of the present invention a rifle is provided equipped with a selective extractor device that allows the shooter to predefine the barrel from which the controlled extraction is to take place. Such aspects of the invention are displayed by a break-open over-and-under rifle equipped with selective controlled hull extraction device according to what is outlined in claim 1.

Further characteristics of the invention form the object of the dependent claims.

The break-open over-and-under rifle according to the present invention comprises an upper barrel and a lower barrel assembled near to a breech thereof in a sleeve to which an action body is hinged through a hinge pin, on the sides of the sleeve two symmetrical side seats are made above a fore-end iron and at the sides of the upper barrel near to the lower barrel and near to a breech of the barrels, each side seat is intended to receive a spring-actuated extractor in sliding engagement, for each of the extractors selector means are foreseen fixedly connected to the sleeve, each able to be positioned in a position of engagement of the corresponding extractor intended to limit its sliding or in a position of disengagement of the extractor intended to allow it to slide freely.

Advantageously, the device according to the present invention makes the extraction of the hulls environmentally-friendly allowing it to be controlled and avoiding them being scattered into the environment.

The characteristics and advantages of a break-open over-and-under rifle equipped with selective controlled hull extraction device according to the present invention shall become clearer from the following description, given as a non-limiting example, referring to the attached schematic drawings, in which.

Figure 1:
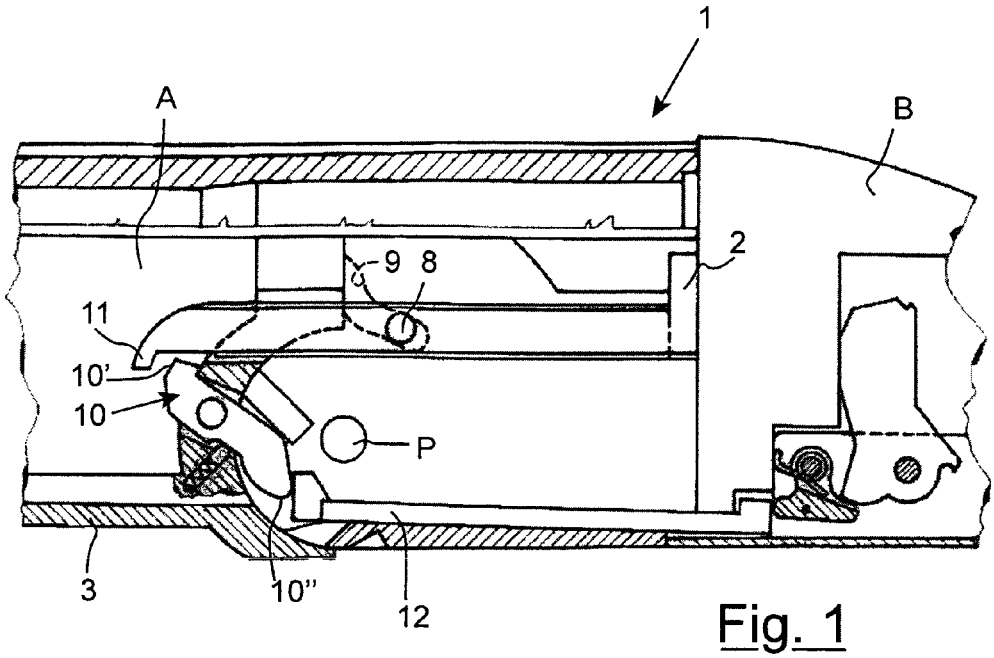
Fig. 1 PRIOR ART
FIGS. 1 to 4 illustrate parts of break-open rifles according to the prior art.
Figure 2:
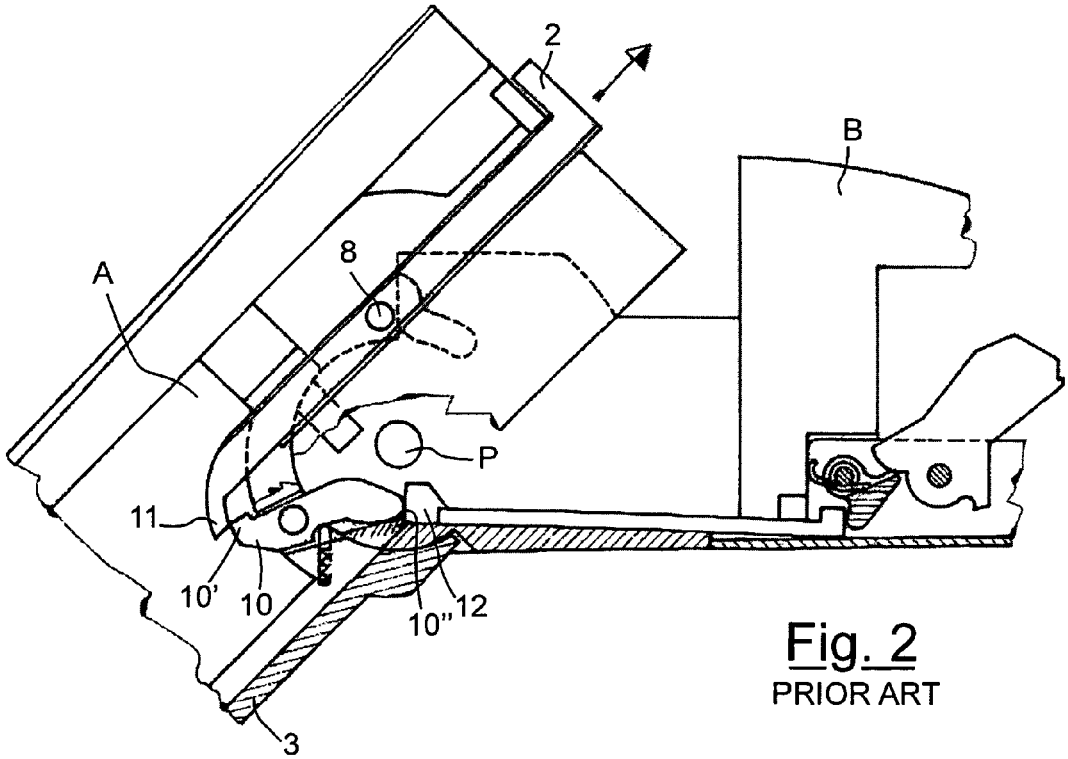
Fig. 2 PRIOR ART
Figure 3:
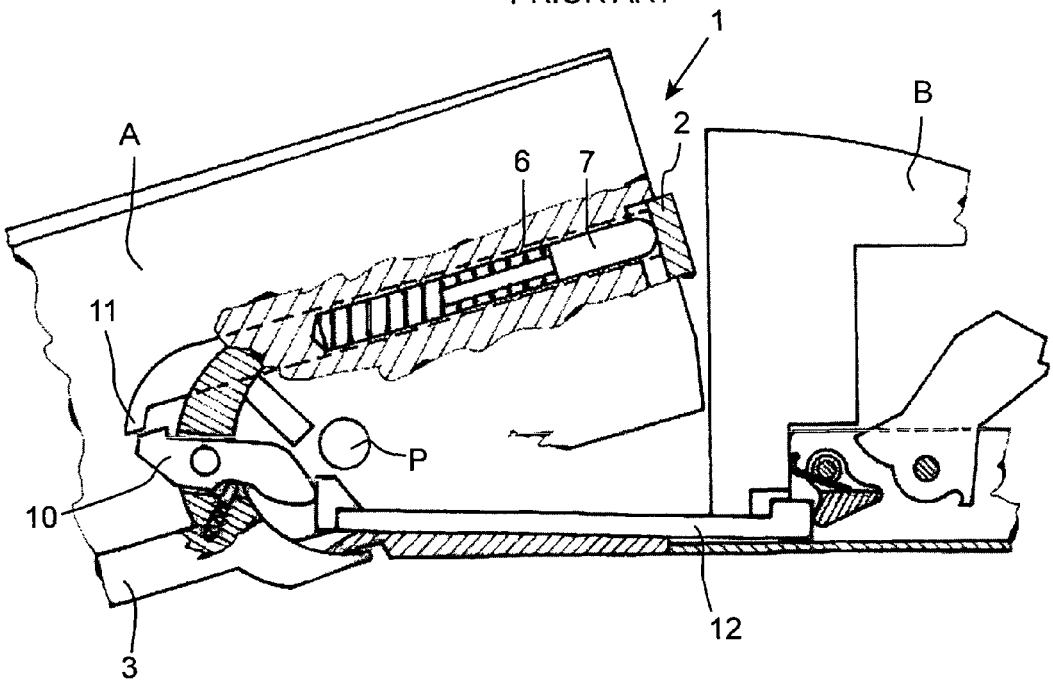
Fig. 3 PRIOR ART
Figure 4:
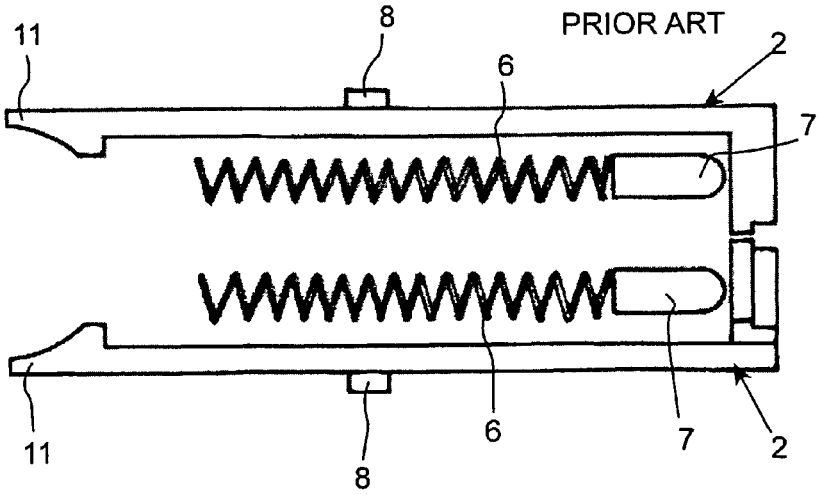
Fig. 4 PRIOR ART
Figure 5:
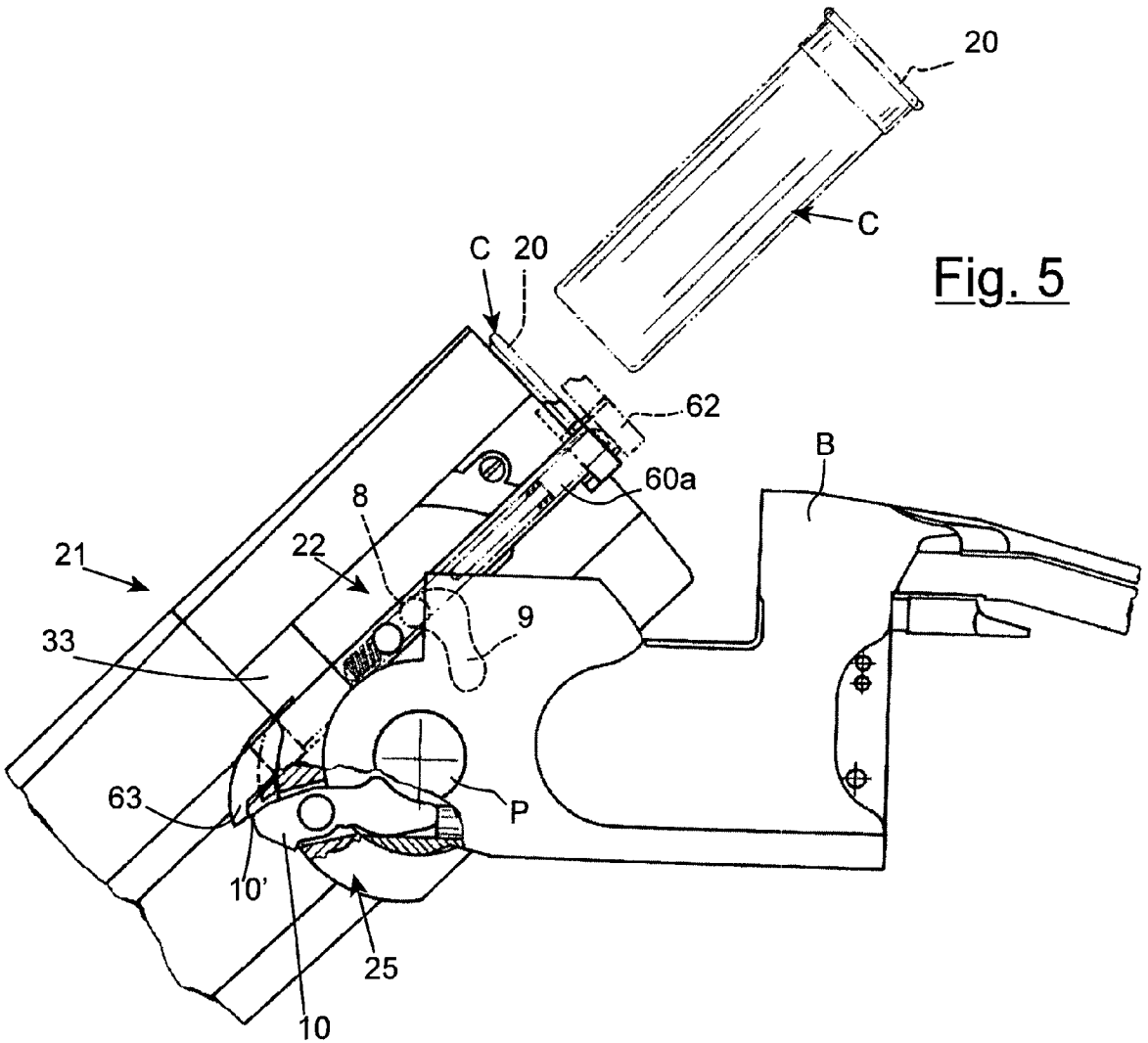
FIG. 5 shows a top side partial view of an over-and-under rifle equipped with the extraction device according to the invention in open position and illustrating the expulsion of a hull.

With reference to FIGS. 6 to 11, a break-open over-and-under rifle 21 equipped with selective controlled hull or cartridge extraction device 60 is shown schematically as a non-limiting example.

In the break-open over-and-under rifle 21 according to the invention, the sleeve carrying the over-and-under barrels 23*s* and 23*i* of the rifle, an upper barrel 23*s* and a lower barrel 23*i* respectively, is indicated with 22, and the action body hinged through the hinge pin P to the sleeve is indicated with B.

A fore-end iron 25 is fixed under the sleeve to control the breaking open of the rifle.

An extractor 60*a*, 60*b* is mounted on each side of the sleeve 22.

For each extractor 60*a*, 60*b* rigid and elastic actuation means are foreseen, the first intended to actuate a predetermined limited initial sliding of the extractor sufficient to extract the hull C from the respective barrel and the second intended to then impart an impulse thrust to the extractor to completely eject the hull from the rifle.

Each extractor 60*a*, 60*b* is indeed initially guided while the barrels are broken open through the rigid means comprising a pin 8 projecting centrally and laterally from the extractor itself that is guided in a seat 9 foreseen in the side of the action body B.

In this first step, known as mechanical lifting, the extractor, after limited sliding, comes out from the sleeve for a predetermined distance equal to about 4 mm sufficient to push the shell rim 20 to the outside so as to allow it to be manually gripped by the shooter.

Then the elastic actuation means of the extractors, in the form of a spring 6 equipped with a thrusting capsule 7, take over.

The rifle is also equipped with a retaining mechanism made on each side of the sleeve through a fore-end iron lever 10 that, through an edge 10' of an end thereof, interferes with a tooth 63 made at the end of the extractor.

The fore-end iron lever 10, through an end 10" thereof opposite the edge 10', is also in contact with a cocking rod 12 foreseen in the lower portion of the action body and fixedly connected to it.

The extraction device 60 according to the present invention is assembled to the action body B of the rifle 21 in which two symmetrical side seats 30 are made for this purpose, arranged on the sides of the action body B above a fore-end iron 25 and at the sides of the upper barrel 23*s* close to the lower barrel 23*i* and close to the breech 24 thereof.

Above each of the two side seats 30 formed longitudinally in the sleeve A, a projection 33 is foreseen having a supporting function of a selector means of the device according to the invention.

Each of the two side seats 30 is intended to receive an extractor 60*a*, 60*b* in sliding engagement and for this purpose has a groove 41 arranged parallel to the barrels and ending in a recess 42 perpendicular to the groove 41 and formed along the edge of the breech 24 so as to engage one of the two barrels.

In the illustrated embodiment, the recess 42 of the left side seat 30 engages the upper barrel 23*s* and the recess 42 of the right side seat 30 engages the lower barrel 23*i*, by right and left meaning the sides of the rifle that can be defined according to the direction that goes from the stock to the muzzle.

The extraction device according to the invention comprises, for each side of the sleeve, an extractor 60*a*, 60*b* in the form of a pad, shaped so as to be slidably housed in the corresponding side seat 30.

A left extractor 60*a* is thus foreseen for the left hand side whereas a right extractor 60*b* is foreseen for the right hand side.

Each of the two extractors 60*a*, 60*b* thus has an elongated portion in the form of a pad 61 at the end of which a nail 62 is made intended to hook the rim 20 of the hull C.

The edge of the nail 62 is concave so as to copy the curvature of the rim 20 of the hull extending for an arc of between 30° and 90° sufficient to hook said rim.

Figure 6:
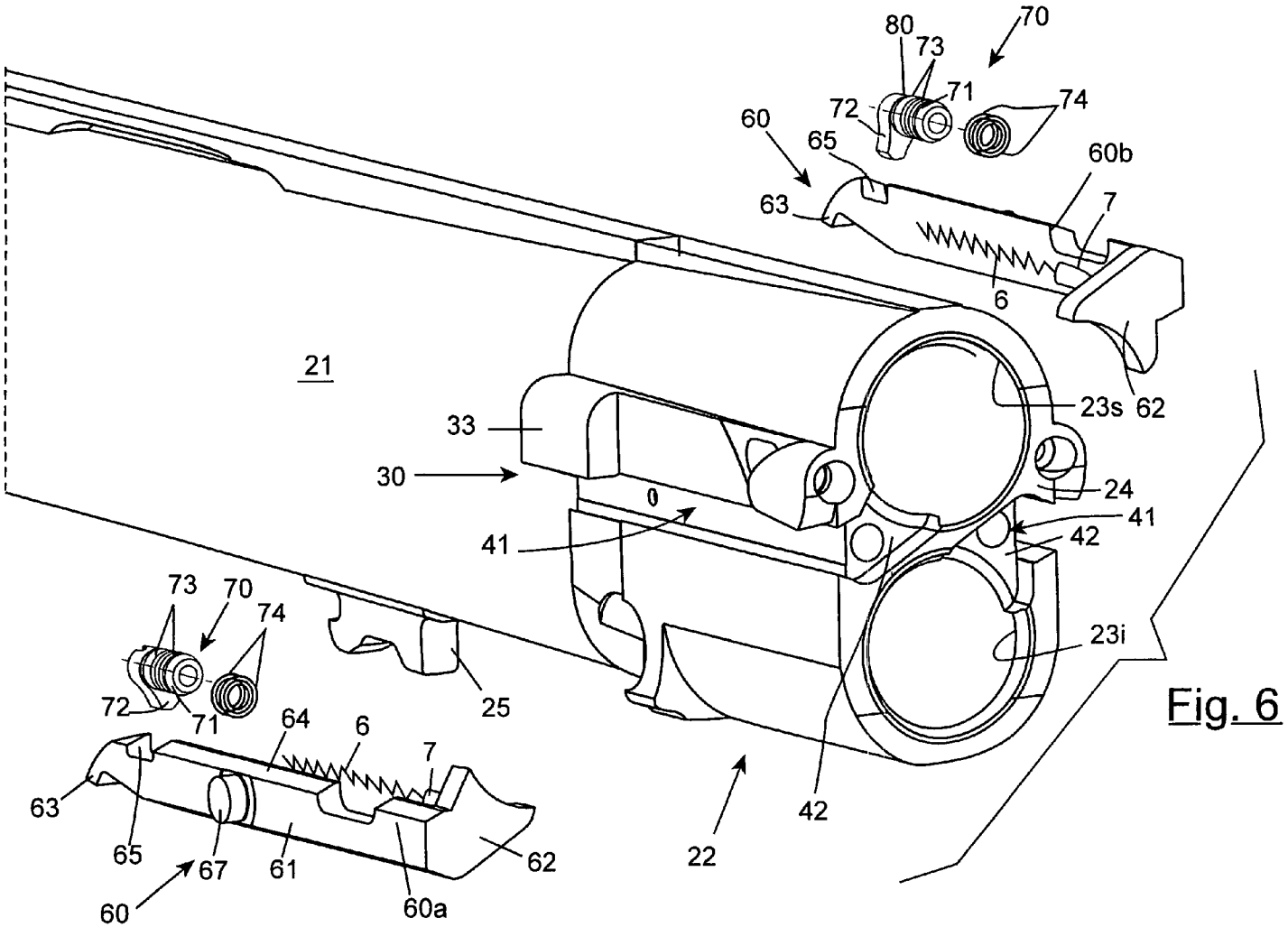
FIG. 6 is an exploded perspective view of a central portion of a break-open over-and-under rifle equipped with selective controlled hull extraction device, object of the present invention.
Figure 7:
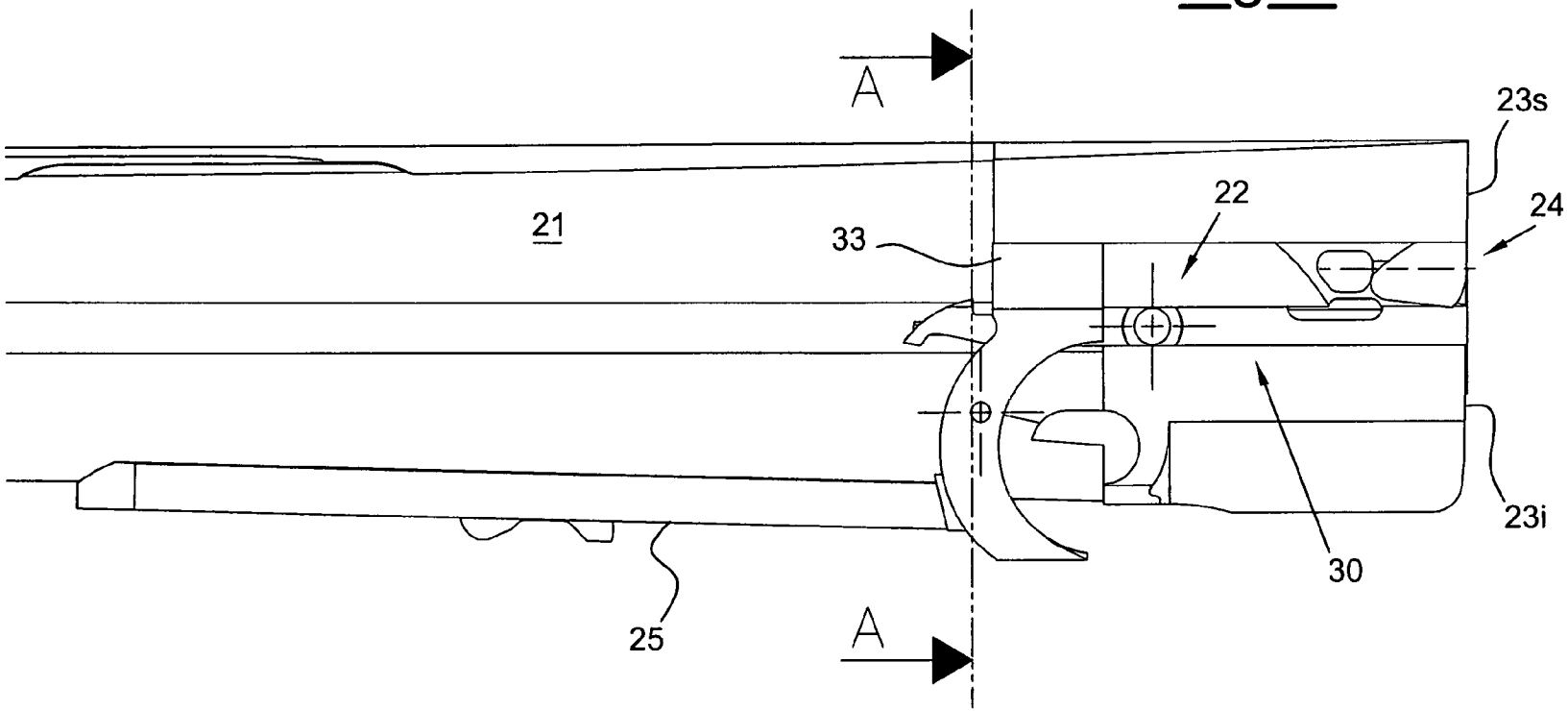
FIG. 7 shows a top side partial view of an over-and-under rifle equipped with the extraction device according to the invention.
Figure 9:
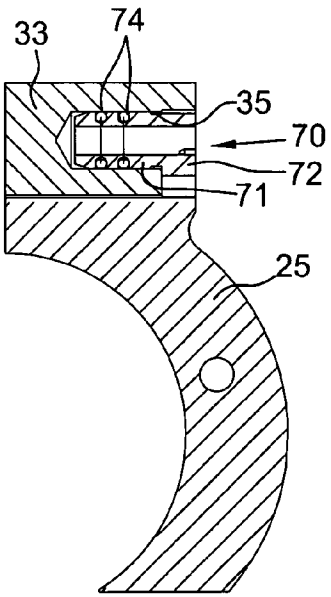
FIG. 9 is a section according to the line B-B of FIG. 8.
Figure 8:
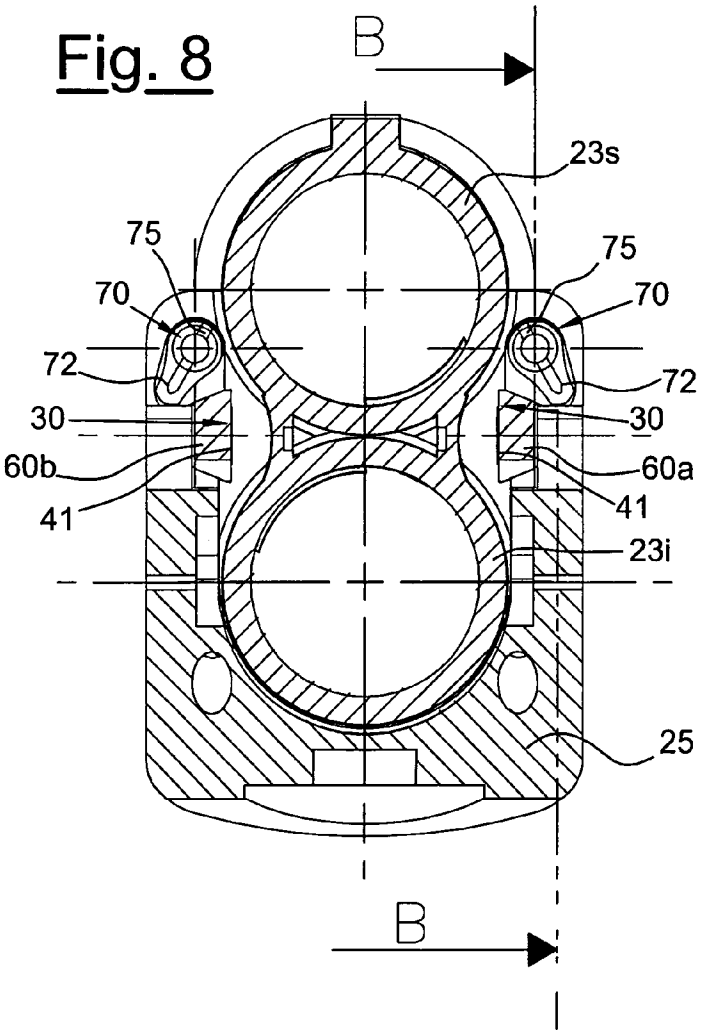
FIG. 8 is a cross section made according to the line A-A of FIG. 7, illustrating a detail of the rifle equipped with the extraction device in disengagement position.
Figure 11:
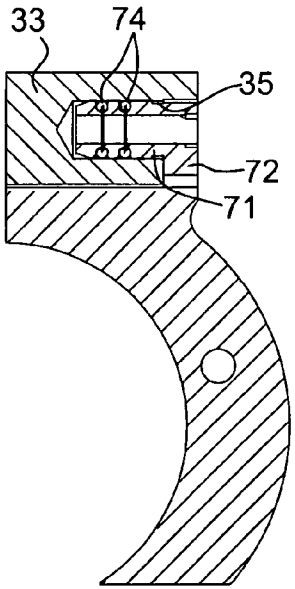
FIG. 11 is a section according to the line B-B of FIG. 10.
Figure 10:
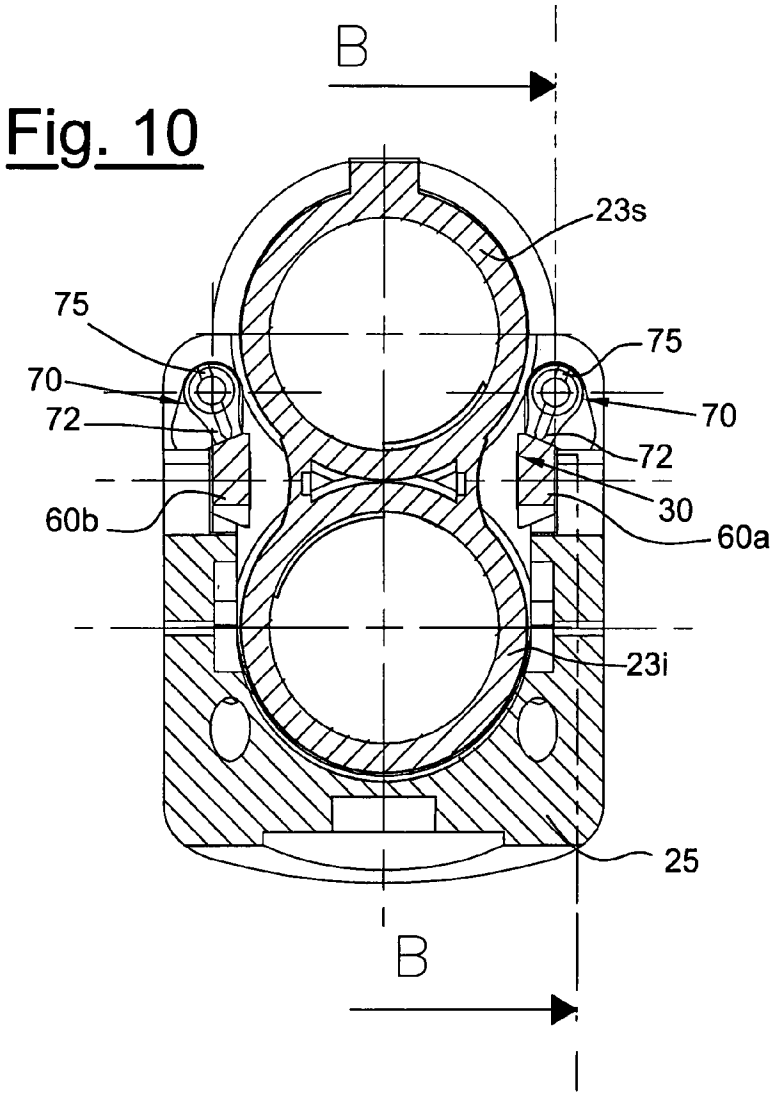
FIG. 10 is a cross section of the over-and-under rifle made according to the line A-A of FIG. 7, illustrating the device in engagement position.

With reference to FIG. 6, it should be noted that the nail 62 of the left extractor 60*a* points upwards to engage the upper barrel 23*s* inserting into the corresponding side seat 30, whereas the nail 62 of the right extractor 60*b* points downwards and engages the lower barrel 23*i*, inserting into the side seat 30 made on the opposite side of the rifle.

The pad 61 of each extractor 60*a*, 60*b*, at the end opposite the nail, has the tooth 63 and, along the upper edge 64, has a notch 65 close to the tooth 63.

In order to select the extractor that must operate when the rifle is opened, selector means 70 are foreseen fixedly connected to the sleeve A suitable for engaging a portion of said extractors 60*a*, 60*b* through rotation, each inserting into the corresponding notch 65 so as to limit the sliding of the corresponding extractor to a few millimeters that is predetermined by the extension of the notch 65, necessary for the extraction of the hull C so as to allow it to be gripped.

On each side of the action body said selector means comprise a selector 70 in the form of a pin 71 to be inserted in a suitable opening 35 made in the front face of the projection 33.

The pin 71 has a small lever 72 passing over it suitable for engaging in the notch 65 so as to allow a predetermined limited translation of the extractor preventing the tooth 63 from escaping the edge 10' of the lever 10 when the rifle is opened and thus preventing the spring 6 from releasing its elastic energy to cause the sudden ejection of the hull C.

The pin 71 is also equipped with one or more annular throats 73 to receive as many O-rings 74 intended to keep the pin under friction inside the opening 35.

The small lever 72 is also equipped with a notch 75 for its actuation through a suitable key as well as manually.

By rotating the small levers, or alternatively just one of them, between the two positions indicated in figures and 10, the extractor respectively goes from the disengagement position that allows the automatic and impulsive ejection of the hull when the rifle is opened, to the engagement position that limits its stroke to a few millimeters allowing the hull to be extracted for the millimeters sufficient for its to be manually gripped but preventing its automatic ejection when the rifle is opened.

The invention claimed is:

1. Break-open over-and-under rifle (21) comprising an upper barrel (23*s*) and a lower barrel (23*i*) assembled close to a breech (24) thereof in a sleeve (A) having sides, said sleeve (A) having an action body (B) hinged thereto through a hinge pin (P), two symmetrical side seats (30) where each of said symmetrical side seats has extractors (60*a*, 60*b*) for a hull (C), said two symmetrical side seats (30) being made on the sides of the sleeve (A) which is arranged at the sides of the upper barrel (23*s*) close to the lower barrel (23*i*) and close to a breech (24) of the barrels, each one of said symmetrical side seats (30) being adapted to receive said extractor (60*a*, 60*b*) in sliding engagement with said symmetrical side seats (30) where each of said extractors (60*a*, 60*b*) is actuated by springs (6), each of said extractors (60*a*, 60*b*) having a tooth (63) and being associated with a separtae selector means (70) fixedly connected to the sleeve (A) where each of said selector means (70) are positionable in an engagement position with the corresponding extractor (60*a*, 60*b*) in order to limit sliding or in a disengagement position with the corresponding extractor (60*a*, 60*b*) in order to allow said corresponding extractor (60*a*, 60*b*) to slide freely, wherein said selector means (70) are rotatable and engage a portion of said extractors (60*a*, 60*b*) through rotation, each selector means (70) being inserted in a corresponding notch (65) so as to limit the sliding of the corresponding extractor to a few millimeters that are predetermined by the extension of the corresponding notch (65), necessary for the extraction of the hull (C) so as to allow for each side of the sleeve (A), each of said selector means (70) comprising a pin (71) insertable in an opening (35) made in the front face of a projection (33) of said sleeve (30), each of said selector means (70) having a small lever (72) that passes over and is adapted to engage notch (65) so as to allow a predetermined limited translation of the extractor (60*a*,60*b*) which prevents the tooth (63) from escaping from an edge (10') of a lever (10) when the rifle is opened and thus preventing the spring (6) from releasing elastic energy and causing sudden ejection of the hull (C).

2. Break-open over-and-under rifle (21) according to claim 1, wherein for each of said extractors (60*a*, 60*b*), a first rigid and elastic actuation means are provided, the first rigid and elastic actuation means comprising a pin (8) projecting centrally and laterally from each extractor and guided in a seat (9) provided in the side of the action body (B), the elastic means comprising a spring (6) equipped with a thrusting capsule (7).

3. Break-open over-and-under rifle (21) according to claim 2, wherein there is also a retaining mechanism made on each side of the sleeve (22) through a fore-end iron lever (10) that through an edge (10') of an end thereof interferes with a tooth (63) made at the end of the extractor, the fore-end iron lever (10) also being in contact through an end (10") thereof opposite the edge (10'), with a cocking rod (12) provided in the lower portion of the action body and fixedly connected to it.

4. Break-open over-and-under rifle (21) according to claim 3, wherein each of the two side seats (30) is intended to receive an extractor (60*a*, 60*b*) in sliding engagement and for this purpose has a groove (41) arranged parallel to the barrels and ending in a recess (42) perpendicular to the groove (41) and formed along the edge of the breech (24) so as to engage one of the two barrels.

5. Break-open over-and-under rifle (21) according to claim 4, wherein the extraction device according to the invention, for each side of the sleeve (A), comprises an extractor (60*a*, 60*b*) in the form of a pad, shaped so as to be slidably housed in the corresponding side seat (30), each of the two extractors (60*a*, 60*b*) having an elongated portion in the form of a pad (61) at the end of which a nail (62) is provided which is adapted to hook a rim (20) of a hull (C).

6. Break-open over-and-under rifle (21) according to claim 5, wherein the pad (61) of each extractor (60*a*, 60*b*), at the end opposite the nail, has the tooth (63) and, along the upper edge (64), a notch (65) close to the tooth (63).

7. Break-open over-and-under rifle (21) according to claim 1, wherein the pin (71) is also equipped with one or more annular throats (73) to receive O-rings (74) to keep the pin under friction inside the opening (35).

* * * * *